US007118791B2

(12) United States Patent
Martel

(10) Patent No.: US 7,118,791 B2
(45) Date of Patent: Oct. 10, 2006

(54) DEVICE FOR CONCEALING CAULKING JOINT AND METHOD

(75) Inventor: Gaetan Martel, Boucherville (CA)

(73) Assignee: RCR International Inc., Bouchervillle (CA)

( * ) Notice: Subject to any disclaimer, the term of this patent is extended or adjusted under 35 U.S.C. 154(b) by 125 days.

(21) Appl. No.: 10/667,439

(22) Filed: Sep. 23, 2003

(65) Prior Publication Data

US 2005/0064126 A1 Mar. 24, 2005

(51) Int. Cl.
*B32B 9/00* (2006.01)

(52) U.S. Cl. ..... 428/40.1; 52/287.1; 52/717.01; 403/231; 428/42.1; 428/83; 428/121; 428/174; 428/192; 428/194

(58) Field of Classification Search ..... 428/40.1, 428/42.1, 121, 174, 192, 194, 83; 403/231; 52/287.1, 717.01
See application file for complete search history.

(56) References Cited

U.S. PATENT DOCUMENTS 2,090,588 A 8/1937 Witsell
2,541,768 A 2/1951 Keller
4,520,605 A 6/1985 Budd
4,601,149 A 7/1986 Dokan
4,706,427 A 11/1987 Zeilinger
4,829,730 A 5/1989 Zeilinger
4,837,997 A 6/1989 Zeilinger
5,045,374 A * 9/1991 Tucker ..... 428/83
5,658,632 A * 8/1997 Krabill ..... 428/43

* cited by examiner

*Primary Examiner*—Nasser Ahmad
(74) *Attorney, Agent, or Firm*—Ogilvy Renault LLP

(57) ABSTRACT

A device for concealing a caulking joint formed between adjacent first and second surfaces comprising an elongated central strip having first and second edges and the strip having first and second sides; a first flap longitudinally connected to the elongated central strip along the first edge, the first flap having a first side adapted to be adhered to a first of the adjacent surfaces such that the first flap conforms to the first of the adjacent surfaces in a watertight manner; a second flap longitudinally connected to the elongated central strip along the second edge, the second flap having a first side adapted to be adhered to a second of the adjacent surfaces such that the second flap conforms to the second of the adjacent surfaces in a watertight manner; and the central strip being adapted to cover the caulking joint with the first side of the central strip facing the caulking joint when the first flap is adhered to the first surface and the second flap is adhered to the second surface, whereby the caulking joint is concealed by the device.

20 Claims, 3 Drawing Sheets

DEVICE FOR CONCEALING CAULKING JOINT AND METHOD

FIELD OF THE INVENTION

The present invention relates to a device for concealing the caulking joint or the like between adjoining surfaces. More specifically, the present invention is directed to a device concealing the caulking joints typically found in the water rooms of households.

BACKGROUND OF THE INVENTION

In a bathroom, joints need to be properly sealed against water infiltration, for example the joints between a tile wall and an adjoining bathtub or the joint between a similar wall and a counter. These joints are usually sealed using a caulking compound such as silicone or latex based products. Over time, the high humidity level in the bathroom can stimulate the growth of mildew on the caulking joints. Also, these joints can be damaged.

To improve the appearance of these joints, a number of moldings have been introduced to replace caulking. Such devices as taught by U.S. Pat. No. 4,706,427, issued on Nov. 17, 1987 to Zeilinger, are often rigid and are designed to be installed, with an adhesive, on an unprotected joint to seal it. While these devices isolate the joint from water exposure and resist deterioration better than a caulking joint, their installation requires the removal of the existing caulking, a process that can be very difficult and time consuming.

Another kind of molding has been proposed to protect a bathroom joint. Such a molding, taught by U.S. Pat. No. 2,541,768, issued on Feb. 13, 1951 to Keller, is installed by being pressed on a fresh joint of caulking before it is cured. It is often flexible and is maintained in place by the cured caulking, effectively protecting it against deterioration. Unfortunately, this device also requires the removal of the existing caulking before installation in order to be able to apply a fresh caulking joint.

Other kinds of protectors are described in the art, such as the drywall finishing edge strips taught by U.S. Pat. No. 5,045,374, issued on Sep. 3, 1991 to Tucker. Such finishing strips are adapted to cover corners of various configurations, such as straight and arched wall corners as well as exterior and interior wall corners. These finishing strips are however limited to drywalls, as they are either too rigid to adequately conform to irregular wall and bathtub surfaces or include a plurality of slits making them unsuitable for use in a bathroom joint.

Accordingly, there is a need for a device that can improve and preserve the appearance of bathroom joints while being easily and rapidly installed.

SUMMARY OF THE INVENTION

It is an aim of the present invention to provide a device that can conceal an existing caulking joint between two adjacent surfaces.

It is another aim of the present invention that the device forms a watertight joint to prevent water infiltration between the surfaces and the device.

It is another aim of the present invention that the device be relatively easy and quick to install over the existing caulking joint.

It is yet another aim of the present invention to provide a method for concealing a joint between adjacent surfaces that does not involve the removal of the existing caulking.

In one aspect of the present invention, there is provided a device for concealing a caulking joint formed between adjacent first and second surfaces comprising an elongated central strip of flexible material having first and second edges and the strip having first and second sides; a first flap longitudinally connected to the elongated central strip along the first edge, the first flap having a first side adapted to be adhered to a first of the adjacent surfaces such that the first flap conforms to the first of the adjacent surfaces in a watertight manner; a second flap longitudinally connected to the elongated central strip along the second edge, the second flap having a first side adapted to be adhered to a second of the adjacent surfaces such that the second flap conforms to the second of the adjacent surfaces in a watertight manner; and the central strip being adapted to cover the caulking joint with the first side of the central strip facing the caulking joint when the first flap is adhered to the first surface and the second flap is adhered to the second surface, whereby the caulking joint is concealed by the device.

In another aspect of the present invention, there is provided a kit for concealing a pair of intersecting joints between adjacent surfaces, comprising a device having an elongated body adapted to have parts of a first side of the body connected to surfaces defining a joint in a watertight manner such that a central strip of the body encloses the joint, the device being adapted to be transversally cut in segments in order to conform with lengths of joints; and a cutting template for shaping ends of a pair of segments of the device in order to obtain complementary ends between the pair of segments meeting at a pair of intersecting joints so as to conceal the pair of intersecting joints.

There is also provided a method for concealing a caulking joint between two adjacent surfaces with an elongated body having a central strip with elongated first and second flaps, comprising the steps of: a) placing and adhering the first flap to one of the surfaces, adjacent to the caulking joint; b) placing and adhering the second flap to the other of the surfaces, adjacent to the caulking joint; such that the central strip is over the caulking joint so that the central strip encloses the caulking joint.

BRIEF DESCRIPTION OF THE DRAWINGS

The features comprising this device are established in the claims presented below. This invention is detailed in the following description of the preferred embodiment interpreted in conjunction with the accompanying drawings, in which:

DETAILED DESCRIPTION OF THE PREFERRED EMBODIMENT

A preferred embodiment of the present invention is shown in FIG. 1A to 2B and will now be described. A device generally shown at 10 is composed of a transversally convex elongated central strip 12 linking two flaps 14*a,b*. Each of the flaps 14*a,b* is terminated by a tapered edge 16*a,b* slightly inclined towards a back side thereof. The flaps 14*a,b* are connected to the central strip 12 through hinge joints 18*a,b*. Each joint 18*a,b* acts as a hinge to allow easy folding of the flaps 14*a,b* from a flat configuration illustrated in FIG. 1A–1B to an installation configuration illustrated in FIG. 2A–2B. An adhesive strip 20*a,b* is preferably installed on the back side of each flap 14*a,b*. A backing strip 21*a,b* protects the exposed side of each adhesive strip 20*a,b*.

In order to protect the covered caulking joint from water infiltration, the device must be made of a water-resisting and watertight material. In a preferred embodiment, the device is made of a flexible water-resisting and watertight plastic including, but not limited to, polyvinyl chloride (PVC), polyethylene, thermoplastic olefin (TPO) and thermoplastic rubber (TPR). It is also possible to use a more rigid material such as aluminum, as long as the joints to be covered are straight and hinge joints 18*a,b* allow the flaps 14*a,b* to reach an appropriate installation configuration. Depending on the material used, the device can be white or beige to form a relatively discreet joint or it can be of any color necessary to obtain a decorative effect with respect to the tile, bathtub or wall color. It is also preferable that the device has a smooth finish to facilitate cleaning. The device must be thick enough so as to withstand the risks of puncture occurring in normal use yet thin enough so as to form an esthetically pleasing joint.

Also, the adhesive strips 20*a,b* are preferably composed of a water-resisting adhesive to form a barrier helping to stop the water from reaching the enclosed caulking joint. It is also possible to manufacture the device 10 without the adhesive strips 20*a,b* installed on the back of the flaps 14*a,b*. In this case, an adhesive (e.g., strips) can be provided in a kit along with the device 10.

Figure 1B:
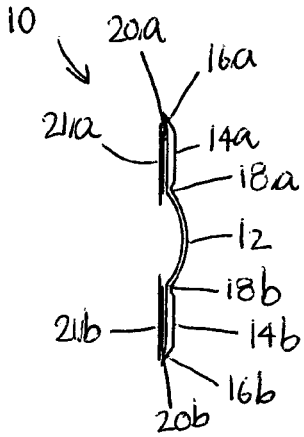
FIG. 1B is an end view of the configuration presented in FIG. 1A.
Figure 1A:
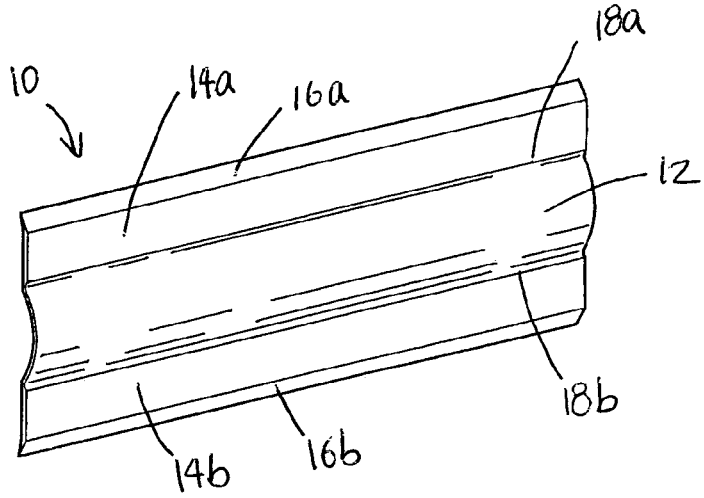
FIG. 1A is a perspective view of a device for concealing caulking joints according to the invention in a flat configuration thereof.
Figure 2B:
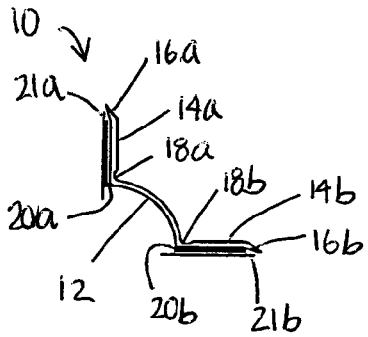
FIG. 2B is an end view of the configuration presented in FIG. 2A.
Figure 2A:
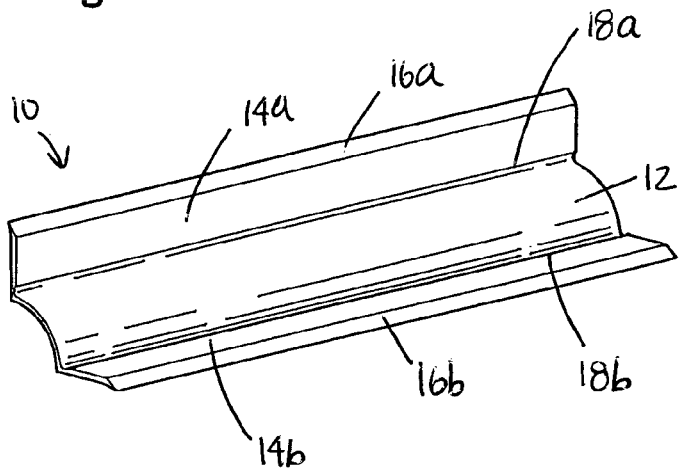
FIG. 2A is a perspective view of the device of the invention in an installation configuration thereof.
Figure 3:
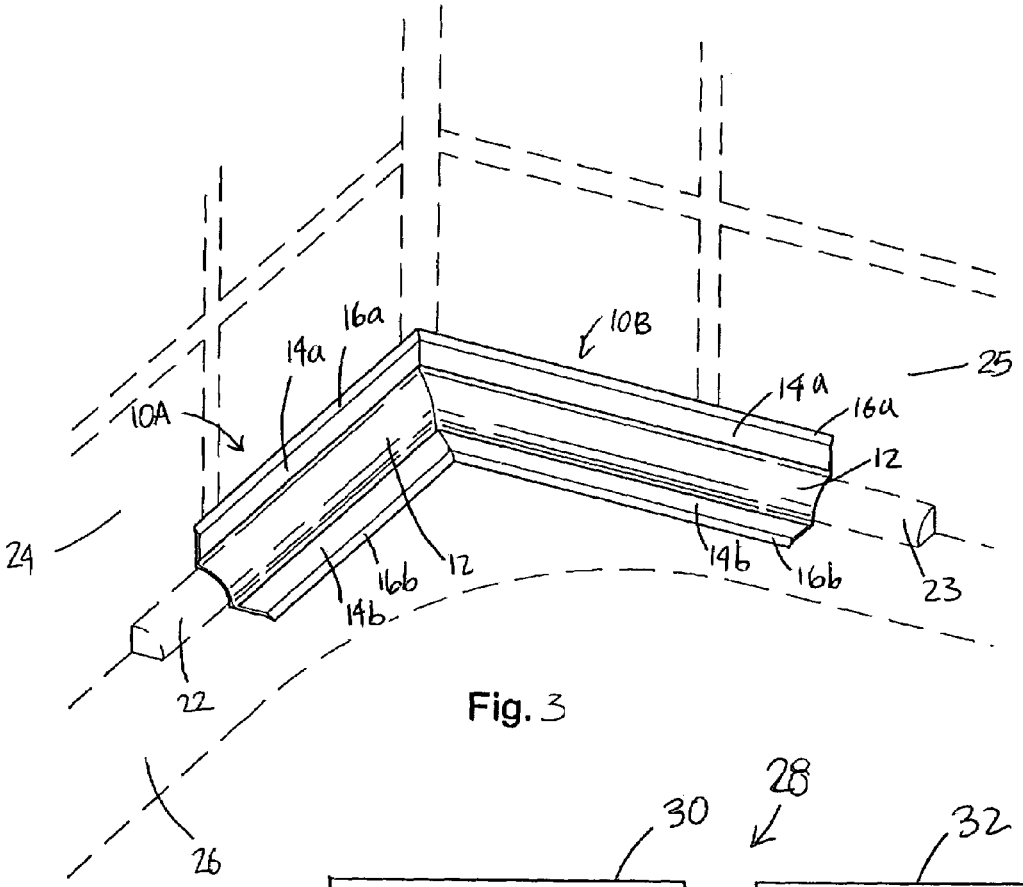
FIG. 3 is a perspective view of the device of the invention installed on consecutive caulking joints between adjacent bathroom walls and a bathtub.

Before installation, it would be preferable to clean the adjoining surfaces and the caulking joint to be covered in order to ensure a good adhesion of the device 10. It is also possible to cut the device 10 to obtain a length or an end geometry needed for a particular caulking joint to be covered. An installation process for the device will be described in the following, the results of which are illustrated in FIG. 3 where two pieces of the device 10A,B are installed on consecutive caulking joints 22,23 between adjacent bathroom walls 24,25 and a bathtub 26. Since it is necessary in this case, devices 10A,B are cut to obtain the end shape needed for an adequate joint where the caulking joints 22,23 meet (details will be given on this process in a following paragraph). Starting with device 10A, the backing tape 21*a* of the adhesive strips 20*a* (as shown in FIG. 1A to 2B) is removed. The flap 14*a* is pressed against the bathroom wall 24 until the adhesive 20*a* is sufficiently cured. The central strip 12 is then placed so as to cover the existing caulking joint 22. The procedure described for flap 14*a* is repeated for flap 14*b*, i.e., the backing tape 21*b* of the adhesive strips 20*b* is removed before pressing flap 14*b* against the bathtub 26 until the adhesive 20*b* is sufficiently cured. The procedure is then repeated for the installation of the device 10B on caulking joint 23 where flap 14*a* is set against the bathroom wall 25 and flap 14*b* is set against the bathtub 26.

During use, the tapered edge 16*a,b* will deflect water to minimize water infiltration between the device and the wall and tub surfaces. The tapered edges 16*a,b* are advantageous when the device is made of a relatively thick material. However, they can be omitted if the material is thin enough so that a straight edge is sufficient to deflect incoming water.

Figure 4:
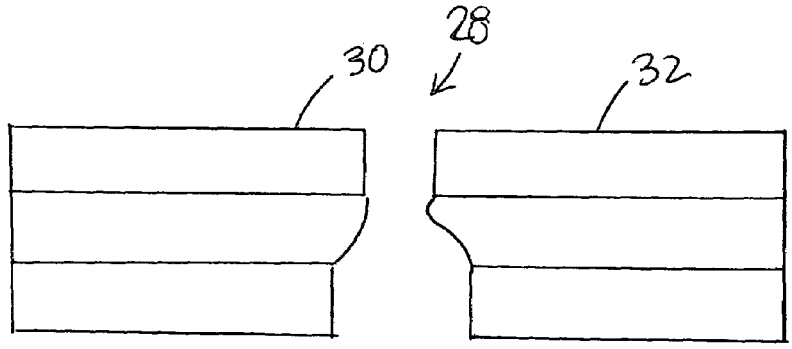
FIG. 4 is a plan view of a template used to cut the device of the invention.

A difficulty often encountered in sealing a joint is forming adequate corner joints, such as shown in FIG. 3. It can be hard to find the appropriate cutting angle needed for adjoining pieces of sealer material in order to obtain an esthetic, watertight junction between the pieces. Accordingly, a cutting template 28, a preferred embodiment of which is presented in FIG. 4, can be provided in a kit with the device 10 in order to facilitate its installation in corner joints. The template 28 is composed of two parts 30, 32. To form an appropriate corner joint, one of the adjoining members 10A (refer to FIG. 3) must be cut transversally according to template part 30 and the other member 10B is cut transversally according to template part 32. The flap 14*a* and central strip 12 of the member 10B will be installed overlapping the flap 14*a* and central strip 12 of the member 10A. Overlapping of the flaps 14*a* and central strips 12 will insure a better watertight joint. The flaps 14*b* of members 10A and 10B can be installed in an adjacent manner or overlapped as well. The template 28 is designed for perpendicular surfaces, but it is contemplated to design other templates for other junction angles. Alternatively, the template may consist of a single member having the different edges on opposite sides, or having a single guide edge suitably used to shape ends of opposed strips to a single complementary shape. It is also contemplated to offer the device 10 in pre-cut strips of standard bathtub lengths and also with ends already cut for a corner joint to further facilitate installation.

Figure 5:
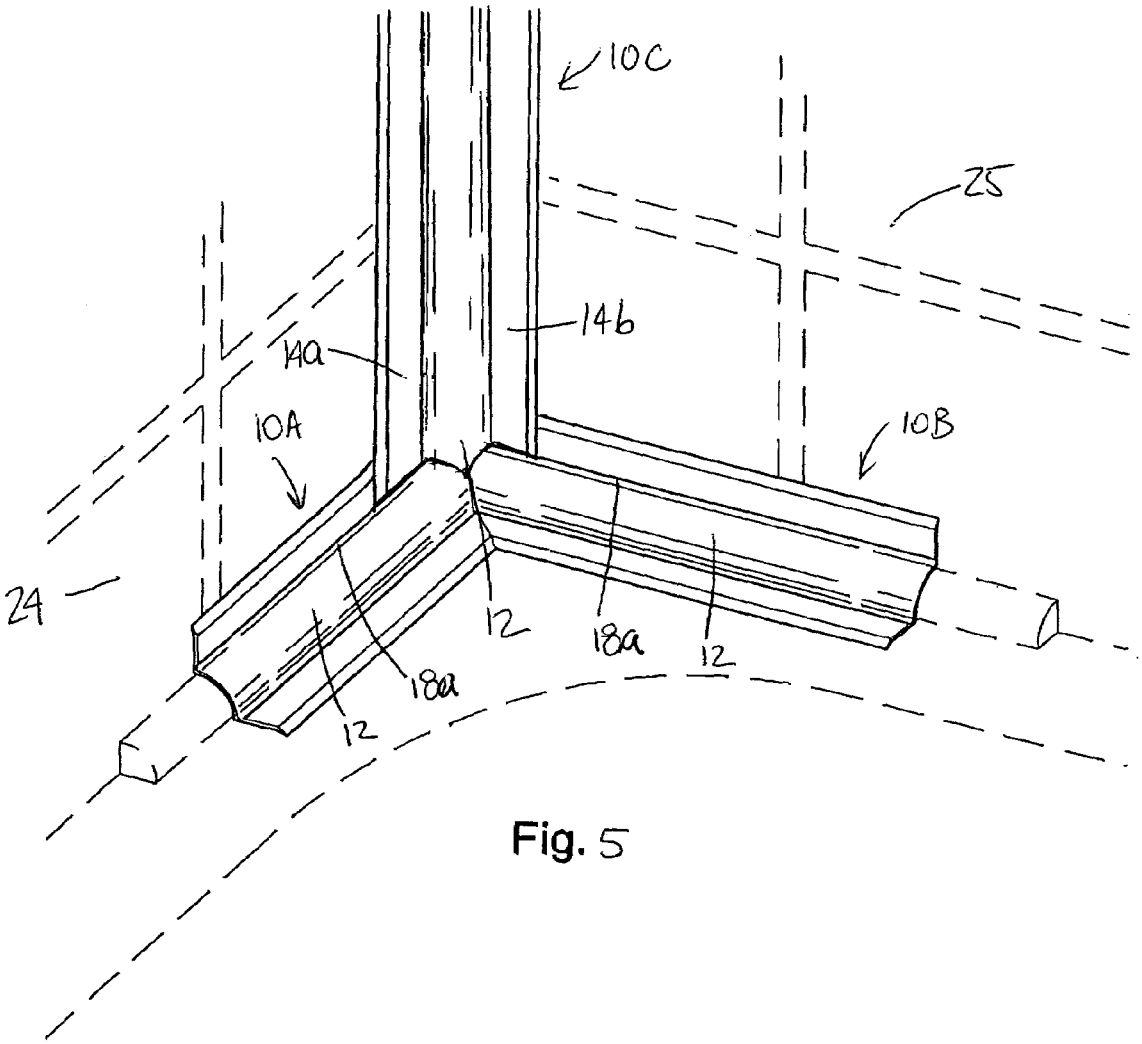
FIG. 5 is a perspective view of the installation of FIG. 3 with the addition of the device of the invention on the caulking joint between the two adjacent bathroom walls.

The device can also be used to conceal the vertical caulking joint between shower walls, as shown in FIG. 5. In this case, a piece of the device 10C is adhesively connected at the junction of the two walls 24,25 in a similar way as the one described for pieces 10A and 10B. There are a number of different ways to insure a watertight joint at the junction of pieces 10A, 10B and 10C. For example, device 10C can be installed over the horizontal junction of devices 10A and 10B after cutting the edge in contact with devices 10A,B to an appropriate shape. One appropriate shape can be seen in FIG. 5 where the flaps 14*a,b* of device 10C have a straight transversal edge aligned with hinge joints 18*a* of devices 10A and 10B and the central strip 12 has a rounded pointed shape to conform to the front side of the central strips 12 of pieces 10A and 10B.

The device is not only adapted to be installed on joints between bathroom walls or between walls and bathtub, but can also be used over similar joints, including, but not limited to, joints between a bathtub and a bathroom floor and joints between a bathroom counter and a wall.

It will be appreciated that the invention is not limited to the specific embodiments described. In particular, the central strip 12 can be transversally straight but very flexible in order to be able to conform to the shape of the existing caulking joint 22. Also, the whole device 10 can be continuous, with no apparent demarcation between the flaps 14*a,b* and the central strip 12, as long as the device is flexible enough to conform to the joint and adjoining surfaces. Furthermore, other water-resistant adhesive means can be used to replace the adhesive strips 20. These variations and other that are apparent to those of ordinary skill in the art are intended to be included in the present invention.

The invention claimed is:

1. In combination, a caulking joint concealing device, adjacent first and second waterproof surfaces, the first surface being a bathtub surface and the second surface being a tile-covered surface, and a caulking joint covering a joint between the bathtub surface and tile-covered surface, the device comprising:

a flexible elongated central strip having first and second opposite longitudinal edges and first and second sides;

a first flexible flap longitudinally connected to the elongated central strip along the first edge, the first flap having a first side adhered to the bathtub surface in a watertight manner;

a second flexible flap longitudinally connected to the elongated central strip along the second edge, the second flap having a first side adhered to the tile-covered surface in a watertight manner; and the central strip covering and concealing the caulking joint with the first side of the central strip facing the caulking joint when the first flap is adhered to the bathtub surface and the second flap is adhered to the tile-covered surface.

2. The combination according to claim 1, wherein an exterior longitudinal edge of each of the first and second flaps is tapered.

3. The combination according to claim 1, wherein longitudinal connection of the first and second flaps to the first and second edges of the central strip are flexible hinges, such that the first and second flaps pivot about a respective one of the hinges from a flat configuration where the first and second flaps are aligned to an installation configuration where the first and second flaps are substantially perpendicular.

4. The combination according to claim 1, wherein the first and second flaps are integrally formed with the central strip and have a lesser degree of flexibility than the central strip.

5. The combination according to claim 1, wherein the first and second flaps are integrally formed with the central strip and have a greater degree of flexibility than the central strip.

6. The combination according to claim 1, wherein the central strip is transversally convex with respect to the second side of the central strip such that the first side forms a concavity to enclose the caulking joint.

7. The combination according to claim 1, wherein the first side of each of the first and second flaps is covered with an adhesive.

8. The combination according to claim 7, wherein the adhesive is in the form of at least an adhesive strip.

9. The combination according to claim 7, wherein an exposed part of the adhesive is protected by a removable backing strip.

10. The combination according to claim 7, wherein the adhesive is in the form of two independent adhesive strips, a first of the adhesive strips being pre-applied on the first side of the first flap and a second of the adhesive strips being pre-applied on the first side of the second flap.

11. The combination according to claim 1, wherein the central strip has no contact with the caulking joint.

12. The combination according to claim 1, wherein the central strip is flexible enough to conform to the caulking joint.

13. In combination, a caulking joint concealing device, adjacent first and second waterproof shower walls, and a caulking compound covering a joint between the first and second shower walls, the device comprising:

a flexible elongated central strip having first and second opposite longitudinal edges and first and second sides;

a first flexible flap longitudinally connected to the elongated central strip along the first edge, the first flap having a first side adhered to the first shower wall in a watertight manner;

a second flexible flap longitudinally connected to the elongated central strip along the second edge, the second flap having a first side adhered to the second shower wall in a watertight manner; and the central strip covering and concealing the caulking joint with the first side of the central strip facing the caulking joint when the first flap is adhered to the first shower wall and the second flap is adhered to the second shower wall.

14. The combination according to claim 13, wherein an exterior longitudinal edge of each of the first and second flaps is tapered.

15. The combination according to claim 13, wherein longitudinal connection of the first and second flaps to the first and second edges of the central strip are flexible hinges such that the first and second flaps pivot about a respective one of the hinges from a flat configuration where the first and second flaps are aligned to an installation configuration where the first and second flaps are substantially perpendicular.

16. The combination according to claim 13, wherein the central strip is transversally convex with respect to the second side of the central strip such that the first side forms a concavity to enclose the caulking joint.

17. The combination according to claim 13, wherein the central strip has no contact with the caulking joint.

18. The combination according to claim 13, wherein the central strip is flexible enough to conform to the caulking joint.

19. The combination according to claim 1, wherein the flexible elongated strip and the first and second flexible flaps are made of a same material, the same material being selected from the group consisting of polyvinyl chloride, polyethylene, thermoplastic olefin and thermoplastic rubber.

20. The combination according to claim 13, wherein the flexible elongated strip and the first and second flexible flaps are made of a same material, the same material being selected from the group consisting of polyvinyl chloride, polyethylene, thermoplastic olefin and thermoplastic rubber.

* * * * *